United States Patent [19]

Koiso et al.

[11] Patent Number: 4,819,578

[45] Date of Patent: Apr. 11, 1989

[54] TONER COLLECTING DEVICE

[75] Inventors: Junichi Koiso; Takayoshi Hashimoto; Toshio Shida, all of Tokyo, Japan

[73] Assignee: Konishiroku Photo Industry Company Ltd., Tokyo, Japan

[21] Appl. No.: 22,187

[22] Filed: Mar. 5, 1987

[30] Foreign Application Priority Data

Mar. 11, 1986 [JP] Japan ..... 61-53252

[51] Int. Cl.[4] ..... G03G 15/08

[52] U.S. Cl. ..... 118/652; 355/15; 239/675; 198/659; 198/671; 222/412; 222/DIG. 1

[58] Field of Search ..... 355/15, 3 DD; 118/652; 430/125; 222/412, DIG. 1; 198/499, 659, 670, 671; 414/300, 301, 319; 239/659, 669, 672, 675

[56] References Cited

U.S. PATENT DOCUMENTS

| | | | |
|---|---|---|---|
| 4,402,103 | 9/1983 | Yanagawa et al. | 355/15 |
| 4,593,997 | 6/1986 | Fox et al. | 355/15 |
| 4,627,716 | 12/1986 | Oka | 355/3 DD X |
| 4,650,312 | 3/1987 | Vineski | 355/15 |
| 4,660,960 | 4/1987 | Fukunaga et al. | 355/15 X |

FOREIGN PATENT DOCUMENTS

| | | | |
|---|---|---|---|
| 3021053 | 12/1981 | Fed. Rep. of Germany | 118/658 |
| 52786 | 5/1981 | Japan | 355/15 |
| 196571 | 11/1983 | Japan | 355/15 |
| 184275 | 9/1985 | Japan | 355/15 |
| 184277 | 9/1985 | Japan | 355/15 |

OTHER PUBLICATIONS

Queener, C. A.; "Flexible Auger Toner Transport"; IBM Technical Disclosure Bulletin; vol. 15; No. 4; p. 1262; 9-1972.

*Primary Examiner*—Shrive Beck
*Assistant Examiner*—Alain Bashore
*Attorney, Agent, or Firm*—Schwartz & Weinrieb

[57] ABSTRACT

A toner collecting device for collecting residual toner removed from an image retainer by a cleaning device after a toner image formed on the image retainer has been transferred to a sheet of paper. The toner collecting device has therein a conveyor device for carrying the residual toner. The conveyor device has its leading end portion disposed at a central portion of the toner collecting device. The upper surface of the toner collecting device has functions to guide transfer paper and to support a transfer electrode, and the leading end portion of the conveyor device is provided with a toner distributing diffusion blade member.

20 Claims, 2 Drawing Sheets

TONER COLLECTING DEVICE

BACKGROUND OF THE INVENTION

1. Field of the Invention

The present invention relates to a toner collecting device for use in an image recording apparatus for conducting a development process with toner and, more particularly, to a toner collecting device which can collect a large amount of toner.

2. Description of the Prior Art

In an image recording apparatus, using the electrophotographic process, such as an electrophotographic reproducing machine or a printer, generally speaking, a photosensitive member (for example, in the form of a belt or drum) acting as an image retainer has its surface exposed to the content of an original document scanned by means of an optical system. The electrostatic latent image thus formed is developed by means of a developing device into an image. This image is transferred to a paper, and the transferred image is fixed upon the paper by means of a fixing device until the paper is discharged.

In this case, the toner having failed to adhere to the paper during the image transfer process remains upon the surface of the photosensitive member. This residual toner is removed by means of a cleaning device and is conveyed to a toner collecting device, which is either provided integrally with or separately from the cleaning device, so as to be collected by means of the toner collecting device.

The device described above cannot, however, accommodate a large quantity of residual toner, so consequently, a large amount of work is required which involves the frequenct replacement of the toner container acting as the toner collecting device or, alternatively, the residual toner must be deposited in the container or hopper containing the original or fresh toner (which means a magnetic toner or non-magnetic toner must be used, respectively). Thus, such system characteristics render it difficult to maintain and manage the copying machine.

SUMMARY OF THE INVENTION

The present invention has been conceived so as to solve the above-specified problem. An object of the present invention is to provide a toner collecting device which exhibits a high degree of efficiently accommodating residual toner.

In order to solve the aforenoted problem, according to the present invention, there is provided a toner collecting device for collecting residual toner, which has been removed from an image retainer by means of a cleaning device after an image, formed on the image retainer by means of toner, has been transferred to a copy sheet of paper, characterized in that a conveyor device for carrying the residual toner is disposed in the toner collecting device.

By adopting the above-specified construction, the present invention is enabled to disperse the residual toner to all parts of the toner collecting device.

BRIEF DESCRIPTION OF THE DRAWINGS

Other objects and features of the present invention will become apparent from the following description to be made with reference to the accompanying drawings, wherein:

FIG. 2(*b*) is a section showing a cleaning device and the toner collecting box;

DESCRIPTION OF THE PREFERRED EMBODIMENT

Figure 1:
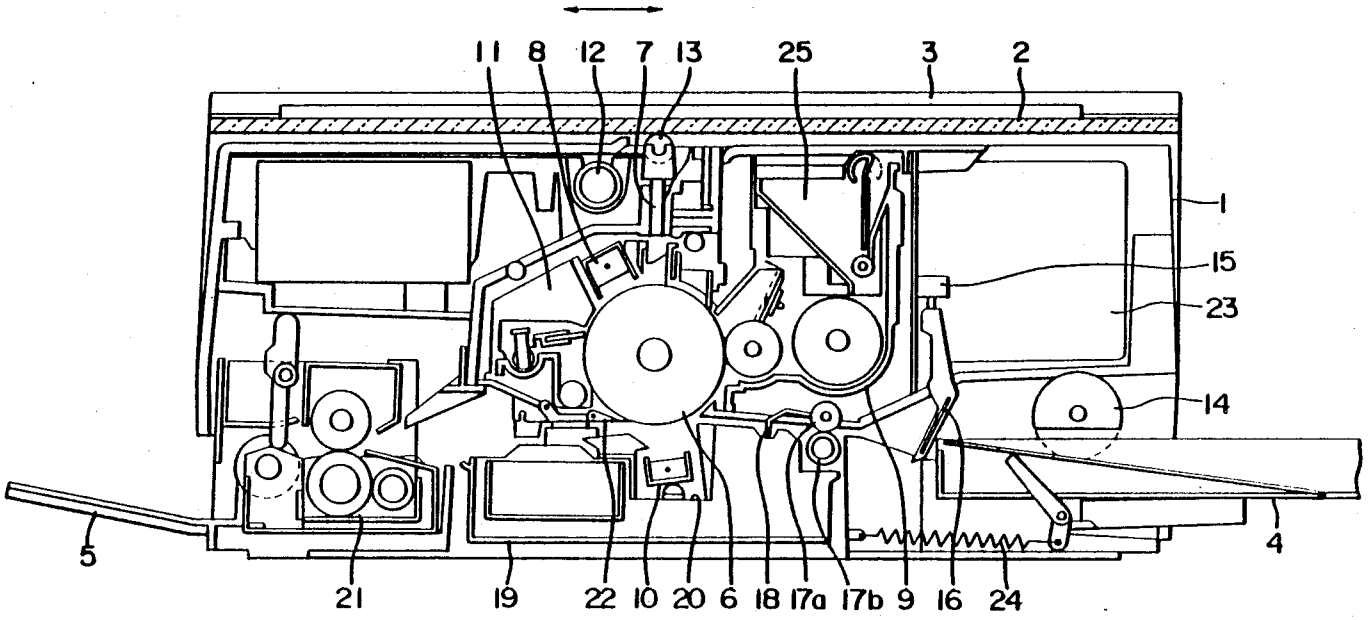
FIG. 1 is a schematic view of an electrophotographic reproducing apparatus.

FIG. 1 is a schematic view showing the whole construction of the electrophotographic reproducing apparatus equipped with a toner collecting device according to the present invention. On the upper surface of a housing 1, there is disposed a document glass plate 2 which is reciprocably movable in horizontal directions (that is, rightward and leftward, as shown). The glass plate 2 can have its upper surface exposed and covered by means of a platen cover 3.

The aforementioned housing 1 is provided within the lower portion of one side thereof with a removable paper feed cassette 4, which contains a sheaf of paper, and within the lower portion of its other side with a paper delivery tray 5.

Figure 2A:
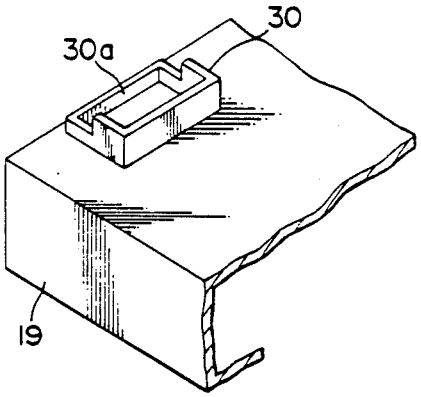
FIG. 2(*a*) is a perspective view showing a portion of a toner collecting box.
Figure 2B:
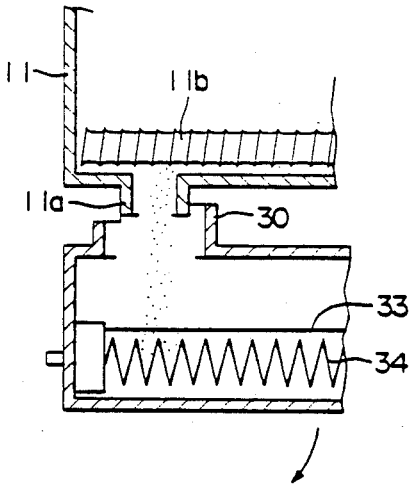

In the central interior portion of the aforementioned housing 1, on the other hand, there is rotatably arranged a photosensitive drum 6 which acts as an image retainer. A converging optical transmitter 7 is positioned above the photosensitive drum 6. A charging device 8 is arranged upstream of the converging optical transmitter 7 in the rotating direction of the aforementioned photosensitive drum 6. Downstream of the optical transmitter 7 in the rotating direction of the photosensitive drum 6, on the other hand, there is arranged a developing device 9, a transfer electrode 10 and a cleaning device 11 sequentially in the recited order. Moreover, the cleaning device 11 is internally provided with a screw 11*b* for continuously conveying the recovered residual waste toner to a chute 11*a* as seen in FIG. 2(*b*).

To one side of the aforementioned converging optical transmitter 7, moreover, there is disposed an exposure lamp 12 for illuminating the aforementioned document glass plate 2 with an optical beam. A support roller 13 supporting the lower surface of the glass plate 2 is arranged above the converging optical transmitter 7 and in such a position that an optical path leading from the exposure lamp 12 to the optical transmitter 7 will suffer no interference.

A semicircular roller 14 is disposed above the paper feed cassette 4 positioned within the lower portion of one side of the aforementioned housing 1. In front of the paper feed cassette 4, on the other hand, there is disposed an actuator 16 for a detecting member 15 which is positioned in the paper conveying region for detecting the fact that the paper has been discharged from the paper feed cassette 4. In the conveying region downstream of the actuator 16 in the paper conveying direction, there is positioned a pair of upper and lower paper feed rollers 17*a* and 17*b*, downstream of which there is positioned a shutter 18 for clamping the leading end of the paper so as to interrupt the conveyance of the paper.

Moreover, the lower surface of the conveying passage downstream of the paper feed rollers 17*a* and 17*b* in the paper conveying direction is defined by the upper surface of a toner collecting box 19, fabricated of metal or resin, which is positioned below the aforementioned developing device 9, photosensitive drum 6 and cleaning device 11. The aforementioned transfer electrode 10 is positioned in a recess 20 of the toner collecting box 19. Alternatively, this toner collecting box 19 may have its container body made of a suitable resin, and a transfer unit and a recording paper conveying unit may be formed of from a metal plate above the toner collecting box 19.

The toner collecting box 19 positioned below the aforementioned developing device 9, photosensitive drum 6 and cleaning device 11 is formed with a chute for receiving the collected toner which drops from such a chute of the cleaning device 11 as is located in a low position of as seen in FIG. 1.

A fixing device 21 is disposed adjacent to the toner collecting box 19 and is located at the side thereof which is opposed to the aforementioned paper feed cassette 4.

Incidentally, reference numeral 22 denotes a separating claw which is disposed below the cleaning device 11 and positioned in the aforementioned conveying passage. Numeral 23 denotes a drive source, and numeral 24 denotes a spring for lifting the internal plate which is disposed inside of the paper feed cassette 4. Numeral 25 denotes a hopper which is positioned above the aforementioned developing device 9.

Moreover, the electrophotographic reproducing apparatus can be lifted up at front side thereof around the lower edge of the back side. By forming the toner collecting box 19 with fulcrums 19*a* and 19*b* at its back side lower edge and by depressing the front side of the toner collecting box 19 in the elevated position of the reproducing apparatus, the lower portions of the aforementioned developing device, photosensitive drum and cleaning device 11 can be rendered accessible.

When during the operation of the reproducing apparatus thus constructed, a document is first placed on the upper surface of the glass plate 2, and this plate 2 is covered with the platen cover 3, and if the control panel is operated so as to start the reproducing operation, the image of the document is irradiated by the exposure lamp 12, and the glass plate 2 starts its reciprocal movements in the horizontal directions with the document, covered by the platen cover 3, on its upper surface. As a result, the document image illuminated by the exposure lamp 12 is transmitted by the converging optical transmitter 7 onto the upper surface of the photosensitive drum 6. Since, in the meantime, the photosensitive drum 6 has been charged by the charging device 8 before it comes to a position below the converging optical transmitter 7, an electrostatic latent image corresponding to the document image is formed on the surface of the photosensitive drum 6.

After this subsequently, the electrostatic latent image is developed into a toner image by the developing device 9 in accordance with the rotations of the photosensitive drum 6. In the meantime, the uppermost paper in the paper feed cassette 4 is synchronously fed out by the semicircular roller 14 so as to pass the actuator 16 of the detecting member 15 and the paired upper and lower paper feed rollers 17*a* and 17*b* until it is clamped in a temporary stand-by mode by the shutter 18 positioned in the conveying passage.

Continuing further, the paper feed is performed at a predetermined time, and the toner image on the surface of the photosensitive drum 6 is transferred to the upper surface of the paper by the action of the transfer electrode 10 which is positioned in the recess 20 of the toner collecting box 19. After this subsequently, the paper having the toner image transferred thereto is separated from the photosensitive drum 6 by the separating claw 22 so that it is conveyed to the fixing device 21.

Moreover, the toner image is fixed by the pressure and heat of the fixing device 21, and the paper having the fixed image is discharged to the upper surface of the paper delivery tray 5.

In the meantime, the photosensitive drum 6 having its paper separated therefrom is cleaned by the cleaning device 11 for a subsequent reproduction, whereas the toner having been scraped off of the drum 6 by the cleaning action of the cleaning device 11 drops from the chute of the cleaning device 11 into the toner collecting box 19, in which it is stored.

Figure 3:
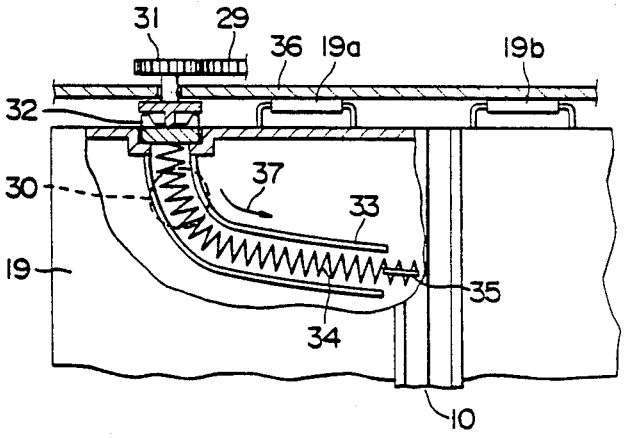
FIG. 3 is a section showing a portion of the toner collecting box.
Figure 4:
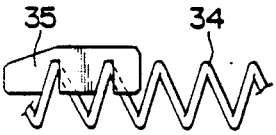
FIG. 4 is a view showing a conveyor screw.

The toner collecting box 19 acting as the toner collecting device used in the electrophotographic reproducing apparatus thus constructed is equipped, as shown in FIG. 2(*a*), on its upper surface with a chute 30 for the residual toner and, as partially shown in section in FIG. 3, on one side thereof with a drive unit 36 for driving a conveyor device for conveying the residual toner from the inside of the toner collecting box 19.

On the other hand, the aforementioned chute 30 is partially formed with an escape recess 30*a* for preventing interference with the toner chute 11*a* of the cleaning device 11 when the toner collecting box 19 is rotated around the fulcrums 19*a* and 19*b* at the rear side lower edge, as shown in FIG. 3.

The aforementioned drive unit 36 transmits the rotational force from a motor (not shown in the drawing) acting as the drive source through a belt 29, a gear 31 and a coupling 32 to a screw 34 which is disposed in a support 33 for conveying the residual toner, as partially shown in FIG. 2(*b*).

Figure 5:
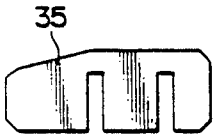
FIG. 5 is a view showing a toner diffusion blade.
Figure 6A:
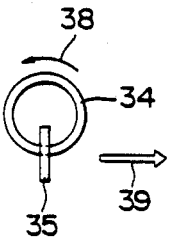
FIGS. 6(*a*) and 6(*b*) are views showing the leading end portion of the toner conveyor screw.
Figure 6B:
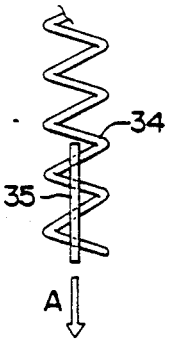

This screw 34 is equipped at its leading end portion with a blade 35, as shown in FIGS. 5, 6(*a*) and 6(*b*), and is disposed in the screw guide support 33 which in turn is disposed in the toner collecting box 19. Since the screw 34 has its leading end portion extended toward a central portion of the toner collecting box, the aforementioned blade 35 is positioned at a central portion of the toner collecting box 19.

The screw 34 is constructed from a screw-shaped plate member for smoothing the conveyance of the toner, which is a bendable spring member.

The screw 34 may be made of a general metallic material such as stainless steel or another metal or a resin.

It goes without saying that the number of screws 34 provided may be not only one but also a plurality.

In the toner collecting box thus constructed, the residual toner scraped off from the photosensitive drum 6 by the cleaning device 11 is sequentially conveyed to the chute 11*a* by the screw 11*b*, as shown in FIG. 2(*b*), so that it is collected within the residual toner chute 30 of the toner collecting box 19 and stored in the toner collecting box 19.

As a result, as shown in FIGS. 2(*b*) and 3, the residual toner drops into an upstream portion of the rotating screw 34 so that it is conveyed to the central portion of the toner collecting box 19 by the aforementioned screw 34 and screw guide support 33. The conveyor device has a larger conveying capacity than that of the cleaning device.

Here, if the screw 34 is rotated by the aforementioned drive unit 36, the residual toner is conveyed in the direction of arrow 37, as shown in FIG. 3.

When the residual toner is further conveyed to the leading end portion of the screw 34, that is, to the central portion of the toner collecting box 19, it is scattered in the direction of the arrow 39 shown in FIG. 6(*a*) by the action of the blade 35 attached to the leading end portion of the screw 34. As a result, the toner in the toner collecting box 19 is scattered in all directions.

The state at this time is shown in FIG. 6(*a*), in which the blade 35 is rotated in the same direction as that of the screw 34, as indicated with an arrow 38. In case that no diffusion plate member such as the blade 35 is mounted on the leading end of the screw 34, the accumulation of the toner in the screw tray of the toner feed device is initiated when the exhaust force of the toner at the leading end portion of the screw 34 due to the rotary conveyor feed action of the screw 34 becomes less than the back pressure of the exhausted toner, so that toner conveying becomes impossible.

However, in the case that the diffusion member is provided on the leading end of the screw 34, as in the present invention, a cavity is always formed in the vicinity of the leading end portion of the screw 34 due to the rotation of the diffusion member, so that the back pressure due to the toner exhausted from the toner feed device is prevented from adversely affecting the portion of screw 34 near the leading end of the screw 34, thereby facilitating the easy exhaust of the toner and the diffusion of the toner into the toner collecting device.

Incidentally, in order to simplify the explanation of FIG. 6(*a*), the scattering directions of the residual toner are limited to one indicated by the arrow 39, but the residual toner is scattered not only in that direction but also in the direction of the arrow 38. At the same time, the toner is extruded in the direction of arrow A, too, by the screw 34 (as shown in FIG. 6(*b*)).

Since the residual toner is conveyed from the chute 30 to the central portion of the toner collecting box 19, it is not accumulated in the vicinity of the chute 30, but the residual toner conveyed to the central portion of the collecting box 19 can be scattered by the blade 35 so that it can be contained in all parts of the toner collecting box 19. This makes it possible to accommodate the residual toner in a quantity substantially equal to the capacity of the toner collecting box 19.

If this capacity of the toner collecting box 19 shown in FIG. 1 is equal to that of the prior art, for example, far more residual toner can be accommodated than with systems characteristic of the prior art so as to simplify the maintenance, to reduce the cost and to reduce the size of the toner collecting box 19 so that the apparatus as a whole can be small in size.

On the other hand, the transfer efficiency of the toner from the aforementioned photosensitive member to the paper is approximately 70%. As a result, residual toner is generated during each transfer operation, and a residual toner of approximately 500 cc to 1,000 cc accumulated after the transfer of 20,000 sheets of paper can be stored.

As has been described hereinbefore, the apparatus of the prior art is defective in that the cleaning device has to be disposed in the vicinity of the photosensitive member so as to achieve its functional requirement. The cleaning device however is so close to the photosensitive member, that if it is integrated with the toner collecting device it requires a space larger than the aforementioned capacity. Since the photosensitive member is surrounded by a variety of devices including the developing device, the separating electrode and the transfer electrode, it is remarkably difficult from a layout requirement viewpoint to integrate the cleaning device and the toner collecting device having the aforementioned capacity in addition to accommodating the above-specified devices. From the structural requirement of the electrophotographing reproducing apparatus, moreover, the cleaning device has to be disposed in the vicinity of the fixing device and the exposure lamp which will generate heat. When the cleaning device is integrated with the toner collecting device, the collected residual toner is influenced by the heat of the exposure lamp so that it cannot be collected or accommodated due to toner blocking or fixation. Moreover, the residual toner exhibits poor fluidity so that it will overflow even though its amount is less than the capacity of the toner collecting device when it is collected through its spontaneous fall within the toner collecting device. Still further, the means for conveying the residual toner to the toner collecting device disposed adjacent to the cleaning device either agitates the residual toner or vibrates the toner collecting device at a low accommodating efficiency level by utilizing the spontaneous fall in the toner collecting device. According to the present invention, there can be provided a more efficient device which can accommodate far more toner than the device of the prior art.

As is apparent from FIG. 1, accordingly, the toner collecting box 19 is disposed in a space below the paper conveying passage, as has not been used so much as a dead space in the prior art, that is, in the central lower portion of the electrophotographic reproducing apparatus, and the upper surface of the toner collecting box 19 is used as the paper conveying passage. Thus, the apparatus can be small in size as a whole by disposing the toner collecting box 19 in that dead space. Moreover, this space is hardly influenced by the heat of the fixing device 21, the exposure lamp 12 and the like, so as to provide an advantage that the troubles which might otherwise result from toner blocking or fixation are reduced. Since the upper surface of the toner collecting box 19 can be used as the conveying passage and the support of the transfer electrode 10, still moreover, the number of the parts required for manufacture can be reduced so as to reduce production costs.

With the construction thus far described, according to the present invention, an amount of residual toner substantially the same as the capacity of the toner collecting device can be accommodated so that it is not necessary to replace the toner collecting device even if a large number of recording operations is carried out.

Obviously, many modifications and variations of the present invention are possible in light of the above teachings. It is therefore to be understood that within the scope of the appended claims, the present invention may be practiced otherwise than as specifically described herein.

What is claimed is:

1. A toner collecting device for collecting toner which has been removed from an image retainer by means of a cleaning device, after a toner image formed upon said image retainer with toner has been transferred to a transfer material, comprising:

a toner collecting container;

a conveyor device, for conveying said removed toner from said cleaning device to said toner collecting container, disposed within said toner collecting container and comprising a rotatable screw having a first proximal end portion for receiving said removed toner from said cleaning device and a second distal end portion for discharging said conveyed removed toner into an interior portion of said toner collecting container; and a diffusion member mounted upon said second distal end portion of said rotatable screw for distributing and conveyed removed toner throughout said toner collecting container.

2. A toner collecting device according to claim 1, characterized in that said conveyor device has its distal end portion disposed at a central portion of said toner collecting container.

3. A toner collecting device according to claim 1, characterized in that said conveyor device has a larger conveying capacity than that of said cleaning device.

4. A toner collecting device according to claim 1, characterized in that:

an upper surface portion of said toner collecting container has means for guiding transfer paper and for supporting a transfer electrode.

5. A toner collecting device according to claim 1, wherein said screw is constructed of a bendable screw-shaped plate.

6. A toner collecting device according to claim 1, wherein said diffusion member is a plate-type blade.

7. A toner collecting device according to claim 5, wherein said screw is made of a metallic material.

8. A toner collecting device according to claim 5, wherein said screw is made of a resin.

9. A toner collecting device according to claim 6, wherein:

said diffusion member has two longitudinally spaced, transversely extending cut-out slot portions defined within an edge portion thereof for engaging consecutive spiral turns of said screw.

10. A toner collecting device as set forth in claim 1, further comprising:

rotary drive means for rotatably driving said conveyor device.

11. A toner collecting device as set forth in claim 1, wherein:

said toner collecting container is disposed beneath said cleaning device so as to receive said removed toner from said cleaning device under the influence of gravity.

12. A toner collecting device as set forth in claim 11, wherein:

said cleaning device has a dependent chute opening downwardly toward said toner collecting container; and said toner collecting container has an upstanding chute opening upwardly toward said cleaning device so as to receive said removed toner from said chute of said cleaning device.

13. A toner collecting device as set forth in claim 1, further comprising:

tubular conduit means surrounding said conveyor screw for confining said toner within a predetermined flow path within said toner collecting container.

14. A toner collecting device as set forth in claim 13, wherein:

said tubular conduit means has a substantially arcuate configuration.

15. A toner collecting system for collecting toner which has been removed from an image retainer by means of a cleaning device, after a toner image formed upon said image retainer with toner has been transferred to a transfer material, comprising:

a toner collecting container;

conveyor means, for conveying said removed toner toward said toner collecting container from said cleaning device, having a first proximal end portion for receiving said removed toner from said cleaning device and a second distal end portion, disposed in fluidic communication with an interior portion of said toner collecting container, for discharging said conveyed removed toner into said interior portion of said toner collecting container; and a diffusion member mounted upon said second distal end portion of said conveyor means and disposed within said toner collecting container for distributing said conveyed removed toner throughout said toner collecting container.

16. A toner collecting system as set forth in claim 15, wherein:

said conveyor means comprises a rotary screw conveyor.

17. A toner collecting system as set forth in claim 15, wherein:

said toner collecting container is disposed beneath said cleaning device so as to receive said removed toner from said cleaning device under the influence of gravity.

18. A toner collecting system as set forth in claim 17, wherein:

said cleaning device has a dependent chute opening downwardly toward said toner collecting container; and said toner collecting container has an upstanding chute opening upwardly toward said cleaning device so as to receive said removed toner from said chute of said cleaning device.

19. A toner collecting system as set forth in claim 16, wherein:

said conveyor comprises a screw-shaped plate member.

20. A toner collecting system as set forth in claim 15, wherein:

said diffusion member comprises a planar blade member.

* * * * *